US009352446B2

(12) United States Patent
Liu

(10) Patent No.: US 9,352,446 B2
(45) Date of Patent: May 31, 2016

(54) DEVICE FOR THE INJECTION OF CMP SLURRY

(71) Applicant: Kojem International Co., Ltd, Hsinchu (TW)

(72) Inventor: Yuan-Chou Liu, Hsinchu (TW)

(73) Assignee: KOJEM INTERNATIONAL CO., LTD., Hsinchu (TW)

( * ) Notice: Subject to any disclaimer, the term of this patent is extended or adjusted under 35 U.S.C. 154(b) by 30 days.

(21) Appl. No.: 14/588,686

(22) Filed: Jan. 2, 2015

(65) Prior Publication Data

US 2015/0190899 A1 Jul. 9, 2015

(30) Foreign Application Priority Data

Jan. 2, 2014 (TW) ..... 103100102 A

(51) Int. Cl.
*B24B 57/02* (2006.01)

(52) U.S. Cl.
CPC ..... *B24B 57/02* (2013.01)

(58) Field of Classification Search
CPC ..... B24B 57/02; B24B 57/00; B24B 57/017; B24B 37/04; B24B 1/04
USPC ..... 451/466
See application file for complete search history.

(56) References Cited

U.S. PATENT DOCUMENTS 3,028,711 A * 4/1962 Campbell ..... B24B 57/00 239/124
5,997,392 A * 12/1999 Chamberlin ..... B24B 57/02 451/287
6,506,098 B1 * 1/2003 Ho ..... B24B 37/04 156/345.12
6,626,741 B2 * 9/2003 Wang ..... B24B 57/02 451/41
6,896,600 B1 * 5/2005 Wu ..... B24B 21/04 222/420
6,953,391 B1 * 10/2005 Majumder ..... B24B 37/04 451/36
6,984,166 B2 * 1/2006 Maury ..... B24B 57/02 451/285
7,052,374 B1 * 5/2006 Lu ..... B24B 57/02 451/60
8,523,639 B2 * 9/2013 Leighton ..... B24B 57/02 451/36
2001/0012751 A1 * 8/2001 Boyd ..... B24B 37/042 451/41
2002/0090896 A1 * 7/2002 Li ..... B24B 53/017 451/56
2004/0229549 A1 * 11/2004 Polyak ..... B24B 37/04 451/41
2006/0027533 A1 * 2/2006 Leng ..... B24B 37/04 216/84
2007/0066187 A1 * 3/2007 Yang ..... B24B 53/017 451/41
2007/0128982 A1 * 6/2007 Lee ..... B24B 57/02 451/5
2008/0202568 A1 * 8/2008 Benner ..... B24B 57/02 134/198
2012/0167924 A1 * 7/2012 Chen ..... B24B 53/017 134/33

* cited by examiner

*Primary Examiner* — George Nguyen
(74) *Attorney, Agent, or Firm* — Muncy, Geissler, Olds & Lowe, P.C.

(57) ABSTRACT

A device for the injection of CMP slurry used in chemical mechanical polishing includes a main body and an outputting member. The main body has an applying end and is configured to be driven to swing over a to-be-polished surface. The outputting member has a channel a plurality of spraying holes communicated with the channel. The channel extends along a central axis. The spraying holes are arranged on the outputting member along a route, and each of the spraying holes faces the to-be-polished surface. The outputting member is pivotally connected to the applying end, so that slurry flows in the channel and is delivered to the to-be-polished surface through the spraying holes. The device for the injection of CMP slurry can evenly distribute the slurry and properly control the slurry in terms of using amount, direction and coverage, and is easy to clean and maintain.

5 Claims, 6 Drawing Sheets

DEVICE FOR THE INJECTION OF CMP SLURRY

BACKGROUND OF THE INVENTION

1. Technical Field

The present invention relates to manufacturing of semiconductor wafers, and more particularly to a device for the injection of CMP slurry used in chemical mechanical polishing.

2. Description of Related Art

Currently, for making a semiconductor chip, tens of thousands of transistors are structured through three-dimensional wiring or multilayer wiring. Therefore, it is important to treat semiconductor wafers using chemical mechanical polishing (CMP) so as to flatten and prepare the surface of the wafer for subsequent procedures.

As shown in FIG. 7, typical CMP equipment introduces a large quantity of slurry 80 onto the surface of a rotating polishing pad 81. The slurry 80 then flows between a wafer 82 and the polishing pad 81 as the latter rotates, so as to polish, clean and lubricate the wafer and condition the surface of the wafer as desired.

However, since the typical CMP equipment introduce slurry onto the polishing pad in a concentrated manner, a large part of the introduced slurry may flow to where is out of the polished area, and the slurry is unlikely to be distributed evenly. This not only causes waste of slurry, which is against to economical consideration and environmental consideration, but also has adverse effects to polishing performance.

SUMMARY OF THE INVENTION

Hence, the primary objective of the present invention is to provide a device for the injection of CMP slurry used in chemical mechanical polishing (CMP), which can evenly polishing distribute slurry during CMP, and can proper control the slurry in terms of using amount, direction and coverage, and is easy to clean and maintain.

For achieving the objective, the device for the injection of CMP slurry of the present invention comprises a main body and an outputting member. The main body has an applying end and is configured to be driven to swing over a to-be-polished surface. The outputting member has a channel a plurality of spraying holes communicated with the channel. The channel extends along a central axis. The spraying holes are arranged on the outputting member along a route, and each of the spraying holes faces the to-be-polished surface. The outputting member is pivotally connected to the applying end, so that slurry flows in the channel and is delivered to the to-be-polished surface through the spraying holes. The device for the injection of CMP slurry can evenly distribute the slurry and properly control the slurry in terms of using amount, direction and coverage, and is easy to clean and maintain.

The invention as well as a preferred mode of use, further objectives and advantages thereof will be best understood by reference to the following detailed description of illustrative embodiments when read in conjunction with the accompanying drawings.

DETAILED DESCRIPTION OF THE INVENTION

Figure 1:
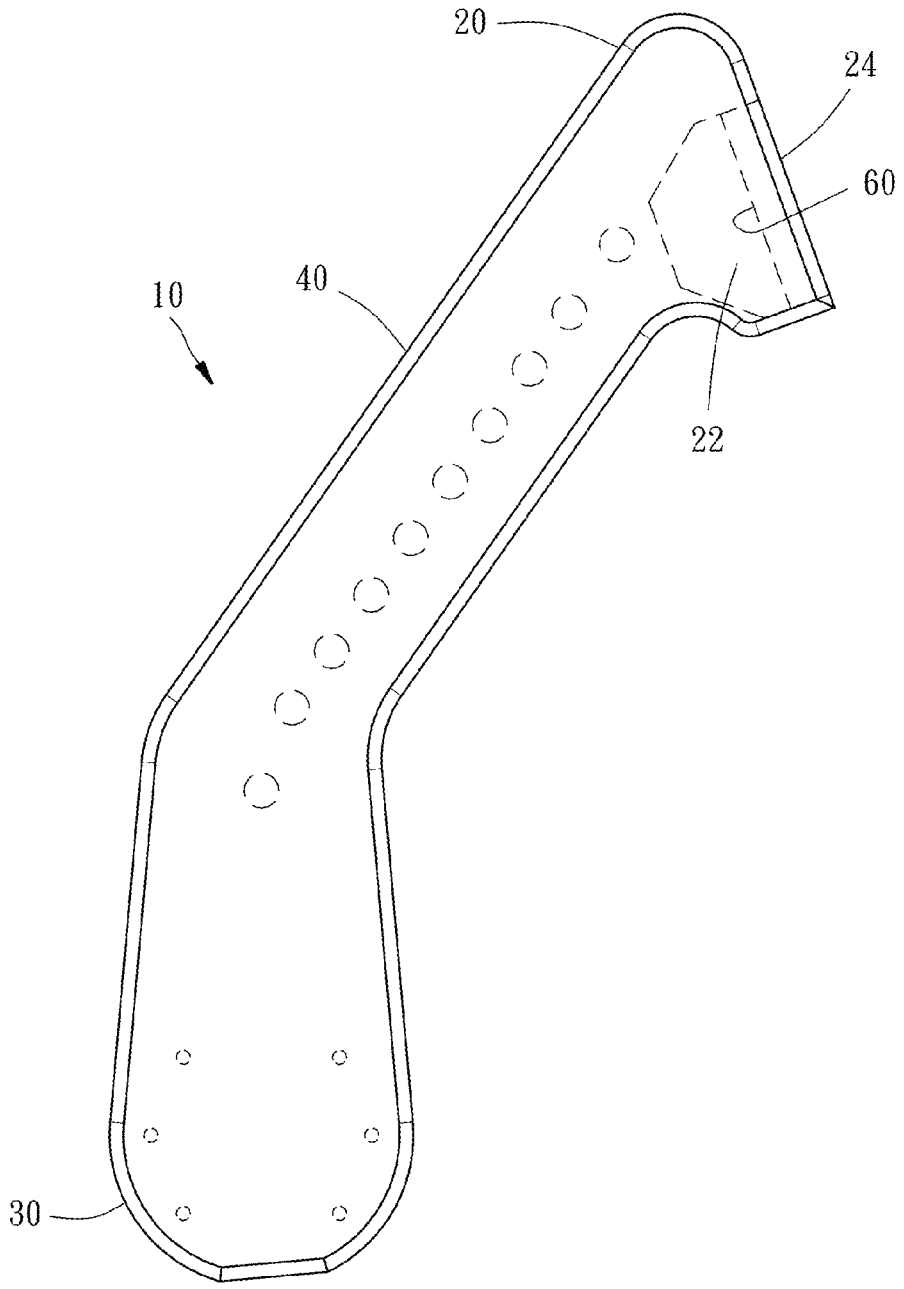
FIG. 1 is a top view of a device for the injection of CMP slurry according to one preferred embodiment of the present invention.
Figure 2:
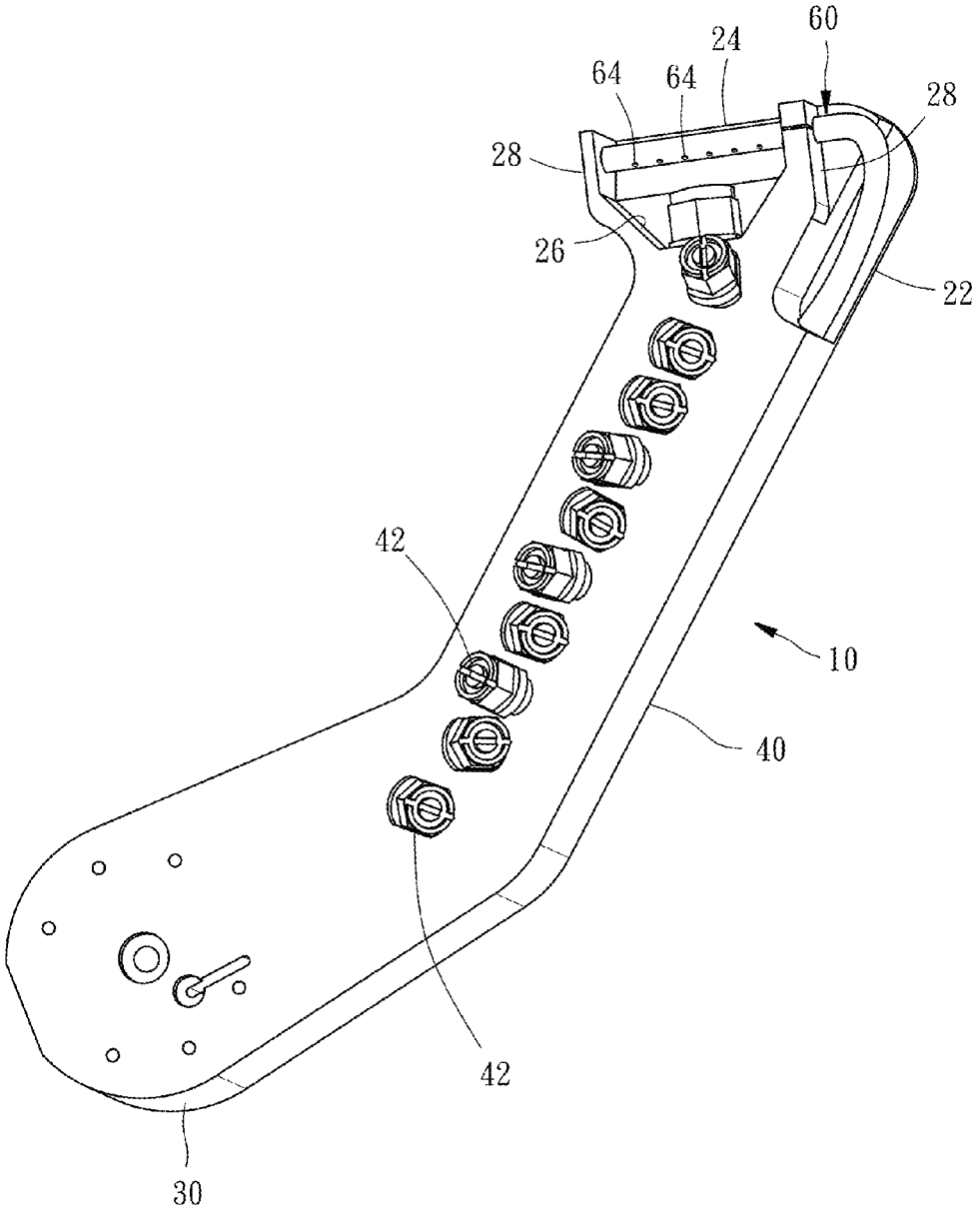
FIG. 2 is a perspective view of the device for the injection of CMP slurry, particularly showing a bottom of a main body thereof.
Figure 3:
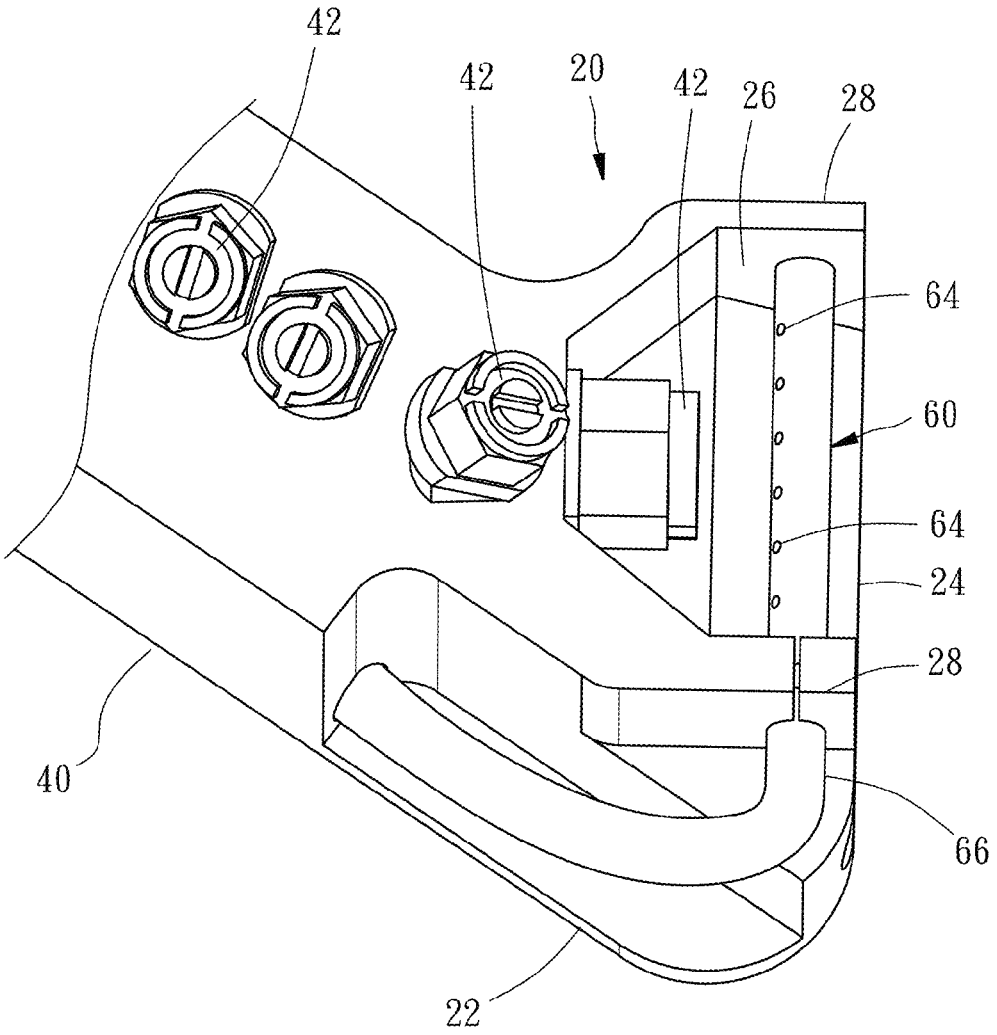
FIG. 3 is a partial, close-up view of the device for the injection of CMP slurry, particularly showing an applying end of the main body.
Figure 4:
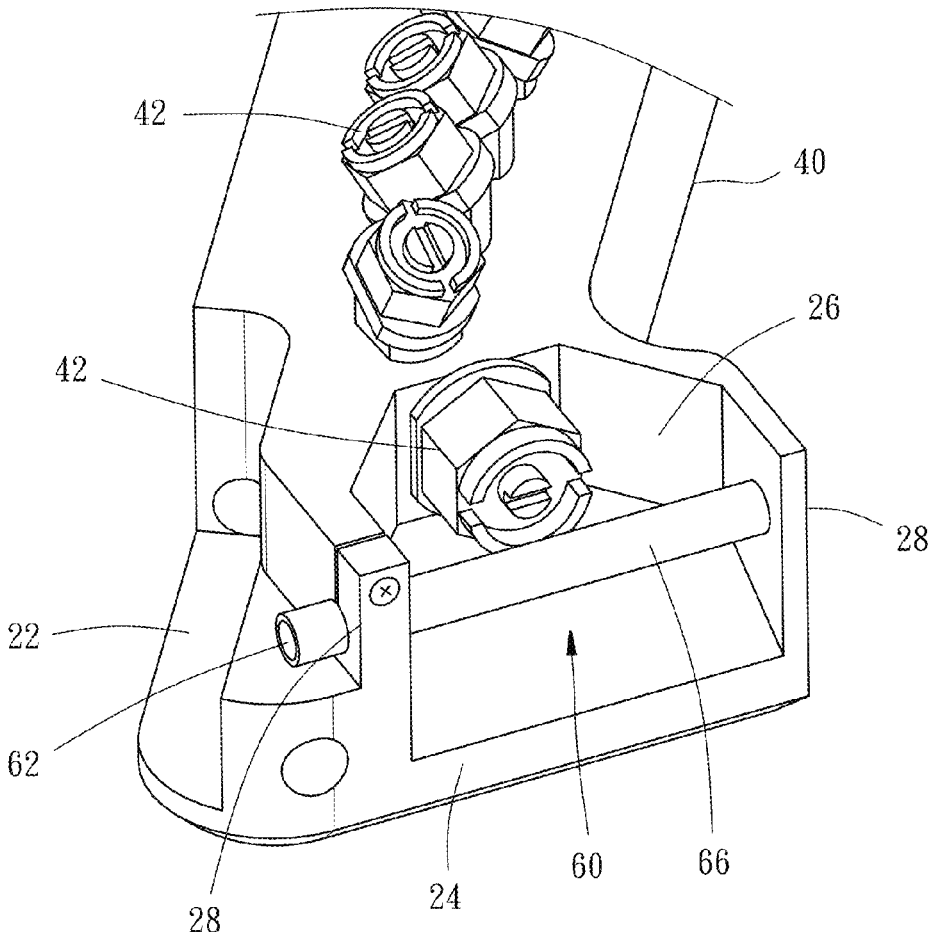
FIG. 4 is similar to FIG. 3 but shows the applying end of the main body from a different viewpoint, wherein an outputting member is only partially shown.

For further illustrating the means and functions by which the present invention achieves the certain objectives, the following description, in conjunction with the accompanying drawings and preferred embodiments, is set forth as below to illustrate the implement, structure, features and effects of the subject matter of the present invention. As shown in FIG. 1 through FIG. 4, according to the present invention, a device for the injection of CMP slurry is used in chemical mechanical polishing (CMP), and comprises a main body 10 and an outputting member 60.

The main body 10 has an applying end 20 and a positioning end 30. A trunk 40 is defined between the applying end 20 and the positioning end 30. The main body 10 has a positioning end 30 attached to a polishing machine (not shown), so that the main body 10 is driven to swing over a to-be-polished surface 50. The applying end 20 has a top portion 22 that has a first side 24. The first side 24 includes a depressed portion 26 so that two separated lateral walls 28 are formed below the top portion 22. The trunk 40 has its bottom surface provided with a plurality of nozzles 42 located in the depressed portion 26. Cleaning liquid (e.g. water) can flow inside the main body 10 for washing and cleaning a semiconductor wafer and a polishing pad. The cleaning liquid is sprayed to a to-be-polished surface 50 through the nozzles 42.

In the present preferred embodiment, the outputting member 60 is a tube. The outputting member 60 is internally formed with a channel 62 extending along a central axis 63. The outputting member 60 is peripherally formed with a plurality of spraying holes 64 that are communicated with the channel 62. The spraying holes 64 are arranged on a tube wall of the outputting member 60 along a predetermined route. In the present preferred embodiment, the route of the spraying holes 64 is a linear route parallel to the central axis 63 of the outputting member 60, and all of the spraying holes 64 face the to-be-polished surface 50. Alternatively, the spraying holes 64 may be arranged on the tube wall 66 along a curved route instead of the linear one. The outputting member 60 has its two ends pivotally connected to two lateral walls 28 of the applying end 20, so that the outputting member 60 is transversely deposited below the top portion 22 of the applying end 20, and close and roughly parallel to the first side 24. The channel 62 of the outputting member 60 is communicated with the slurry in the main body 10. The channel allows the slurry to flow therein and to be distributed onto the to-be-polished surface 50 through the spraying holes 64.

Figure 5:
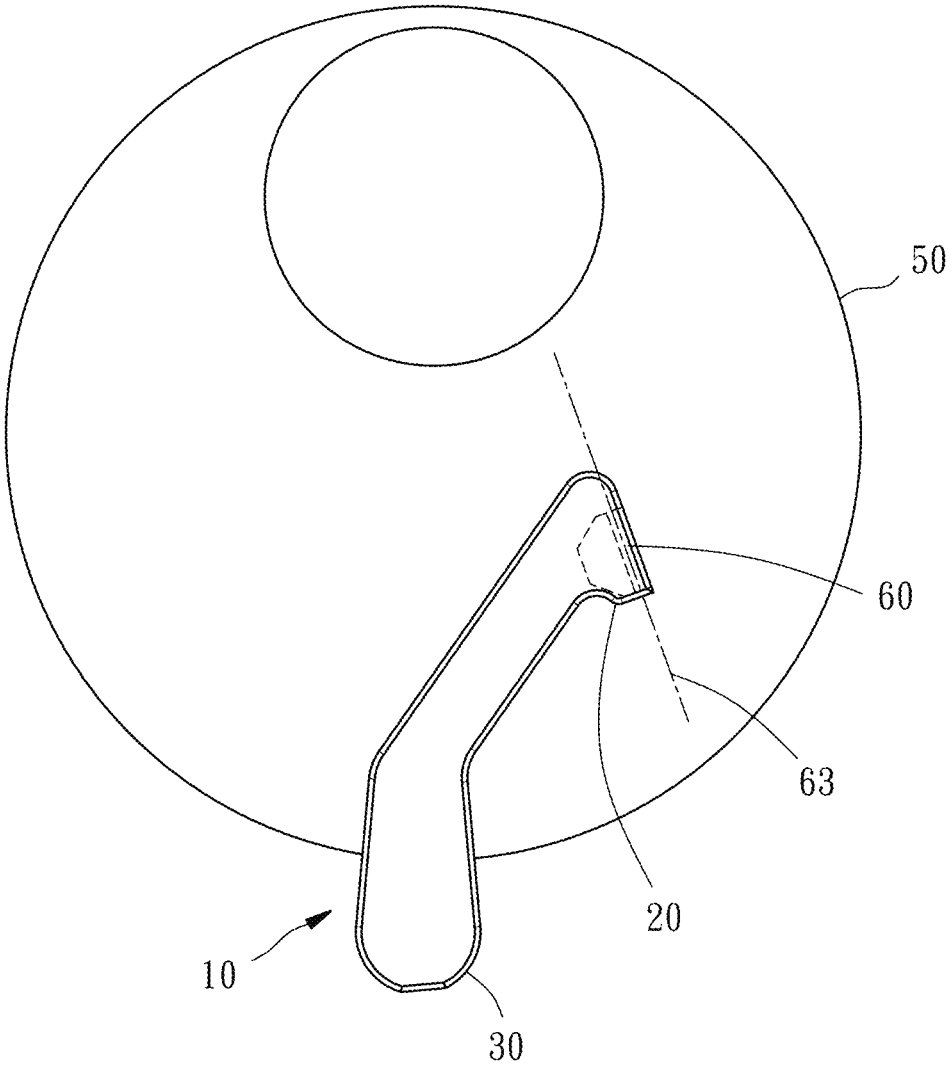
FIG. 5 is top view showing the device for the injection of CMP slurry working with CMP equipment.
Figure 6:
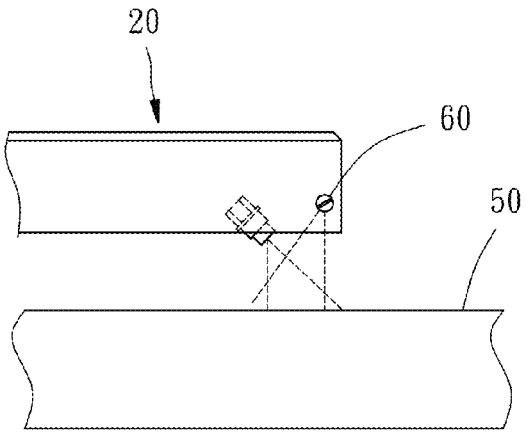
FIG. 6 is a side view showing the device for the injection of CMP slurry working with CMP equipment.
Figure 7:
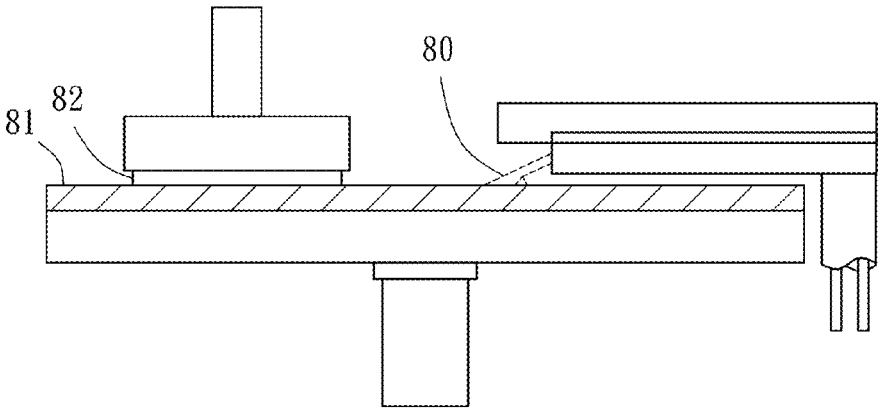
FIG. 7 is a side view of conventional CMP equipment.

With the foregoing configuration, as shown in FIG. 5, since the main body 10 is attached to the polishing machine in a swingable manner, when the main body 10 swings and the applying end 20 is located over the to-be-polished surface 50, as shown in FIG. 6, the slurry can be linearly sprayed onto the to-be-polished surface 50 through the spraying holes 64 because the spraying holes 64 as disclosed are dimensionally different from the conventional slurry delivering tube. More particularly, the diameter of the spraying hole 64 is smaller than that of the conventional slurry delivering tube. The linearly sprayed slurry can be evenly distributed over the to-be-polished surface 50 and the latter rotates. Therefore, the problem about waste of slurry happening in the conventional CMP equipment can be eliminated.

Additionally, since the outputting member 60 is pivotally connected to the applying end 20, it can be posed at different angles as desired, and can be even detached from the applying end 20, so that the spraying holes 64 can be pointed to different directions and areas as the outputting member 60 moves with respect to the applying end 20, thereby facilitating chemical mechanical polishing and making the disclosed device easy to maintain.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A device for the injection of CMP slurry, comprising:

a main body, having an applying end and being configured to be driven to swing over a to-be-polished surface; and an outputting member, having a channel and a plurality of spraying holes communicated with the channel, the channel extending along a central axis, the spraying holes being arranged on the outputting member along a route, each said spraying hole facing the to-be-polished surface, and the outputting member being pivotally connected to the applying end, so that slurry flows in the channel and is delivered to the to-be-polished surface through each said spraying hole.

2. The device for the injection of CMP slurry of claim 1, wherein the outputting member is a tube, and the spraying holes are roughly linearly arranged on a tube wall of the outputting member.

3. The device for the injection of CMP slurry of claim 1, wherein the applying end has a top portion that has a first side, in which a depressed portion is provided on the first side, and two separated lateral walls are formed below the top portion, while the outputting member is pivotally connected between the two lateral walls.

4. The device for the injection of CMP slurry of claim 1, wherein the main body has a positioning end, and a trunk is defined between the applying end and the positioning end, in which a bottom surface of the trunk is provided with a plurality of nozzles facing the to-be-polished surface.

5. The device for the injection of CMP slurry of claim 1, wherein the outputting member is pivotally and detachably connected to the applying end.

* * * * *